US011603972B2

(12) United States Patent
Iwasaki

(10) Patent No.: US 11,603,972 B2
(45) Date of Patent: Mar. 14, 2023

(54) LIGHT GUIDE FOR VEHICLES, AND LAMP FOR VEHICLES

(71) Applicant: Ichikoh Industries, Ltd., Isehara (JP)

(72) Inventor: Kazunori Iwasaki, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 17/284,258

(22) PCT Filed: Sep. 27, 2019

(86) PCT No.: PCT/JP2019/038254

§ 371 (c)(1),
(2) Date: Apr. 9, 2021

(87) PCT Pub. No.: WO2020/075536

PCT Pub. Date: Apr. 16, 2020

(65) Prior Publication Data

US 2021/0381668 A1 Dec. 9, 2021

(30) Foreign Application Priority Data

Oct. 10, 2018 (JP) ..... JP2018-191631

(51) Int. Cl.
*F21S 41/24* (2018.01)
*F21S 41/25* (2018.01)
(Continued)

(52) U.S. Cl.
CPC ..... *F21S 41/24* (2018.01); *F21S 41/147* (2018.01); *F21S 41/25* (2018.01); *F21S 41/37* (2018.01)

(58) Field of Classification Search
None
See application file for complete search history.

(56) References Cited

U.S. PATENT DOCUMENTS

2003/0174492 A1 9/2003 Ohkawa
2008/0080201 A1* 4/2008 Specht ..... F21S 41/43 362/507

(Continued)

FOREIGN PATENT DOCUMENTS

EP 2 865 937 A1 4/2015
EP 3 115 683 A1 1/2017

(Continued)

OTHER PUBLICATIONS

International Search Report dated Nov. 26, 2019 in PCT/JP2019/038254 filed on Sep. 27, 2019, 2 pages.

(Continued)

*Primary Examiner* — Elmito Breval
(74) *Attorney, Agent, or Firm* — Oblon, McClelland, Maier & Neustadt, L.L.P.

(57) ABSTRACT

A vehicle light guide 40 that guides light from a light source 10 toward a projection lens 30 includes an incident surface 41 on which light from the light source 10 is incident, a reflective surface 45 that reflects light from the incident surface 41, and an exit surface 44 that outputs light reflected on the reflective surface 45. The reflective surface 45 includes, on at least a part thereof, a light diffusing part 50 where at least either one of a plurality of convex parts 51 and a plurality of concave parts 52 that diffuse light are formed.

6 Claims, 3 Drawing Sheets

(51) Int. Cl.
*F21S 41/147* (2018.01)
*F21S 41/37* (2018.01)

(56) References Cited

U.S. PATENT DOCUMENTS

| | | | | |
|---|---|---|---|---|
| 2010/0053987 | A1* | 3/2010 | Nakabayashi | F21S 41/151<br>362/538 |
| 2012/0275173 | A1* | 11/2012 | Hamm | F21S 41/143<br>362/487 |
| 2015/0131324 | A1* | 5/2015 | de Lamberterie | F21S 43/236<br>362/511 |
| 2016/0341386 | A1 | 11/2016 | Iha et al. | |
| 2018/0128443 | A1* | 5/2018 | Taudt | F21S 41/24 |

FOREIGN PATENT DOCUMENTS

| | | | |
|---|---|---|---|
| JP | 2008-21659 | A | 1/2008 |
| JP | 2010-212203 | A | 9/2010 |
| JP | 2012-256491 | A | 12/2012 |
| JP | 5889499 | B2 | 3/2016 |
| JP | 2016-524802 | A | 8/2016 |
| JP | 2016-184578 | A | 10/2016 |
| JP | 2017-212037 | A | 11/2017 |
| WO | WO 2014/032071 | A1 | 3/2014 |
| WO | WO 2016/162921 | A1 | 10/2016 |
| WO | WO 2017/015684 | A1 | 2/2017 |

OTHER PUBLICATIONS

Extended European Search Report dated Jun. 20, 2022 in European Patent Application No. 19871997.3, 9 pages.

* cited by examiner

LIGHT GUIDE FOR VEHICLES, AND LAMP FOR VEHICLES

TECHNICAL FIELD

The present disclosure relates to a light guide for vehicles and a lamp for vehicles.

BACKGROUND ART

Conventionally, in a lamp for vehicles, a technique relating to a light guide for vehicles (light guide) for guiding light from a light source toward a projection lens, and forming a predetermined light distribution pattern is known. For example, PTL 1 discloses a lighting device having a series of optical waveguides and in which each of the optical waveguides guides a light ray between an inlet surface and an outlet surface. Further, PTL 2 discloses a light projecting device including a light source, a lens assigned to the light source, and a total reflection light guide provided between the light source and the lens. Further, PTL 3 discloses a vehicle headlamp including an LED, a projection lens, and a light distribution member grounded between the LED and the projection lens.

CITATION LIST

Patent Literature

PTL 1: Japanese Unexamined Patent Application Publication No. 2016-184578

PTL 2: Japanese Translation of PCT International Application Publication No. 2016-524802

PTL 3: Japanese Patent No. 5889499

SUMMARY OF THE INVENTION

Problems to be Solved by the Invention

In a lamp for vehicles including a light guide for vehicles as described above, it may not be possible to acquire a sufficient thickness in a predetermined area of a light distribution pattern. Therefore, there is a possibility that s desired light distribution performance cannot be acquired due to, for example, vertical aiming of the lamp for vehicles in a vertical direction, misalignment of each component, and the like.

In view of the above, an object of the present disclosure is to secure a sufficient thickness of a predetermined area on a light distribution pattern, and acquire a desired light distribution performance.

Means for Solving the Problem

One aspect of the present disclosure provides a light guide for vehicles that guides light from a light source toward a projection lens. The light guide for vehicles includes: an incident surface on which light from the light source is incident; a reflective surface that reflects light incident from the incident surface; and an exit surface that outputs light reflected on the reflective surface. The reflective surface includes, on at least a part thereof, a light diffusing part where at least either one of a plurality of convex parts and a plurality of concave parts that diffuse light are formed.

Effect of the Invention

According to the present disclosure, it becomes possible to secure a sufficient thickness in a predetermined area of a light distribution pattern, and acquire a desired light distribution performance.

MODE FOR CARRYING OUT THE INVENTION

In the following, an embodiment is described in detail with reference to the accompanying drawings.

The present invention is not limited by the embodiment. In addition, components in the following embodiment include those that can be easily replaced by those skilled in the art, or those that are substantially the same. In the following description, each of front and rear directions, up and down directions, and left and right directions is a direction in a state that a light guide for vehicles and a lamp for vehicles are mounted in a vehicle, and indicates a direction when a traveling direction of the vehicle is viewed from a driver's seat. In the present embodiment, it is assumed that the up and down directions are in parallel to a vertical direction, and the left and right directions are a horizontal direction. In the following description, the left and right directions of the vehicle are referred to as a "direction X", and the front and rear directions of the vehicle are referred to as a "direction Y".

Figure 1:
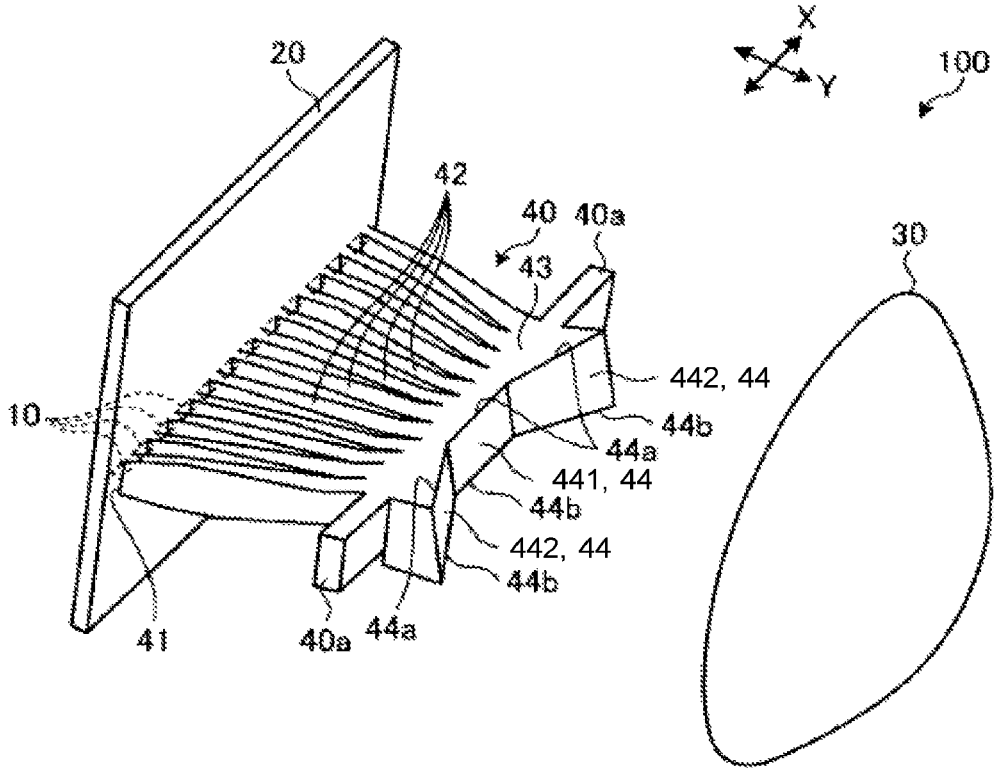
FIG. 1 is a perspective view showing a lamp for vehicles according to an embodiment.
Figure 2:
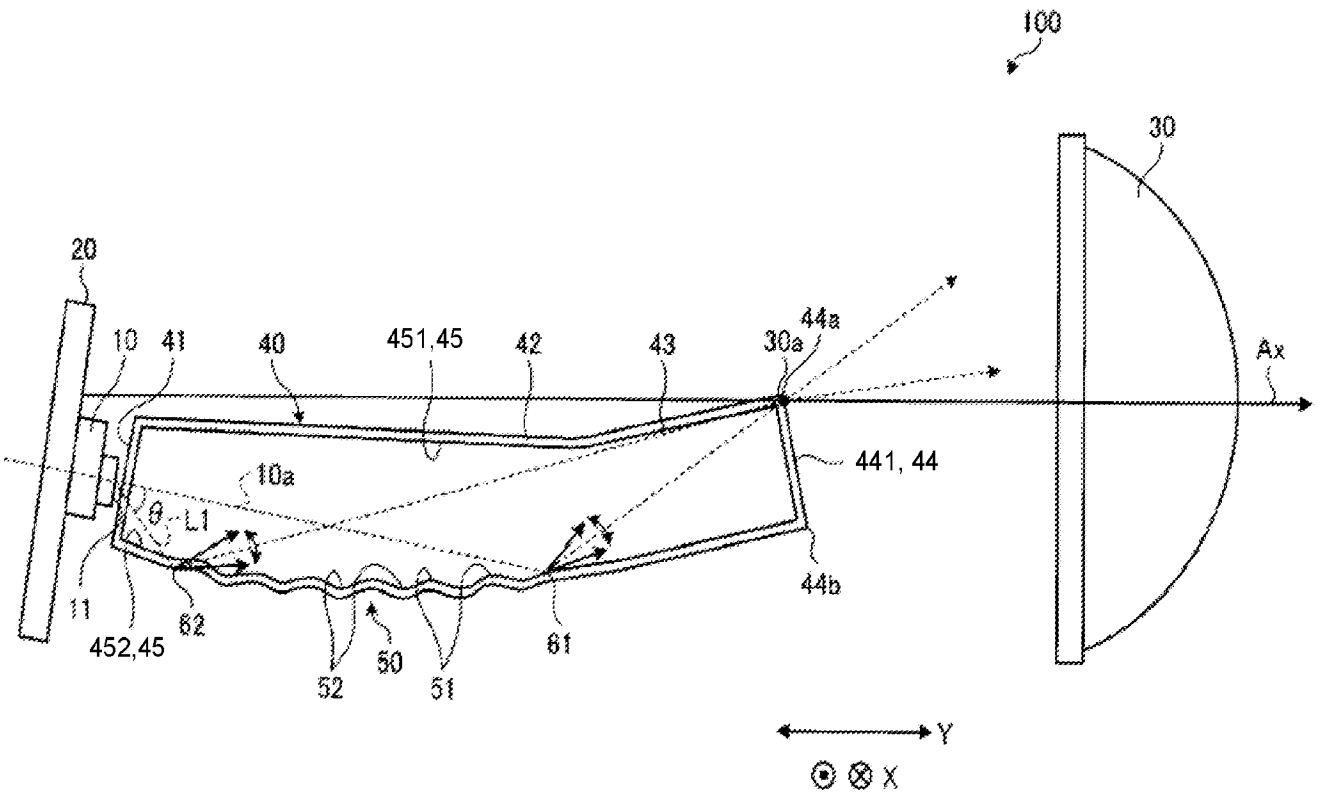
FIG. 2 is a cross-sectional view showing a vehicle light guide according to the embodiment.

FIG. 1 is a perspective view showing a lamp for vehicles according to an embodiment, and FIG. 2 is a cross-sectional view showing a light guide for vehicles according to the embodiment. FIG. 2 shows a cross section of a central part of the light guide for vehicles in the direction X. As shown in FIG. 1, a vehicle lamp 100 includes a plurality of light sources 10, a light source substrate 20, a projection lens 30, and a vehicle light guide 40. In the present embodiment, the vehicle lamp 100 irradiates, in a predetermined irradiation direction, an adaptive device beam (ADB) pattern (hereinafter, referred to as an "ADB light distribution pattern") in which a high beam pattern is dynamically adjusted in such a way that an oncoming vehicle or a preceding vehicle is not dazzled. The vehicle lamp 100 is housed in a lamp chamber formed of an unillustrated lamp housing and an unillustrated lamp lens (for example, a transparent outer lens or the like). Note that other lamp units such as an unillustrated low beam lamp unit and an unillustrated high beam lamp unit may be disposed in the lamp chamber.

The plurality of light sources 10 are, for example, semiconductor type light sources such as LEDs, OELs, and OLEDs (organic ELs). The plurality of light sources 10 are mounted on the light source substrate 20. As schematically shown in FIG. 1, the plurality of light sources 10 are disposed side by side along the direction X in a vehicle-mounted state. As shown in FIG. 2, each of the light sources 10 has a light emitting surface 11 that emits light in such a way as to form a Lambertian distribution. When the vehicle lamp 100 is mounted on a vehicle, the light emitting surface 11 faces the front side.

The projection lens 30 is disposed on the front side of the vehicle with respect to the plurality of light sources 10, the light source substrate 20, and the vehicle light guide 40. The projection lens 30 is supported by, for example, an unillustrated lens holder. As shown in FIG. 2, the projection lens 30 has a focal point 30*a* and an optical axis AX. The projection lens 30 irradiates light emitted from the light source 10 and guided through the vehicle light guide 40 toward the front side of the vehicle.

The vehicle light guide 40 is disposed between the plurality of light sources 10 and the projection lens 30, and guides light from the plurality of light sources 10 toward the projection lens 30. The vehicle light guide 40 is formed by, for example, resin molding. As shown in FIGS. 1 and 2, the vehicle light guide 40 includes a plurality of incident surfaces 41, a plurality of light guide parts 42, a merging part 43, and an exit surface 44.

The plurality of incident surfaces 41 are disposed side by side along the direction X. Each of the incident surfaces 41 is disposed side by side along the direction X in association with each of the light sources 10. Each of the light guide parts 42 extends from each of the incident surfaces 41 toward the projection lens 30. The merging part 43 is a portion where each of the light guide parts 42 merges at an end thereof on a side opposite to the incident surface 41. As shown in FIG. 1, the merging part 43 is formed with a mounting part 40*a* projecting in the direction X. The vehicle light guide 40 is fixed to an unillustrated mounting member by the mounting part 40*a* within the lamp chamber.

As shown in FIG. 2, the light guide part 42 and the merging part 43 form a reflective surface 45 that reflects light incident from the incident surface 41 toward the exit surface 44. The reflective surface 45 includes an upper reflective surface 451 located on the upper side in the vertical direction, and a lower reflective surface 452 located on the lower side in the vertical direction. In the present embodiment, light reflected on the lower reflective surface 452 is output from the exit surface 44 with respect to a vicinity of an upper end 44*a* of the exit surface 44 in the vertical direction as a focal point.

The exit surface 44 is formed on an end surface of the merging part 43 on the projection lens 30 side. The exit surface 44 outputs, toward the projection lens 30, light from each of the light sources 10, which is guided from each of the incident surfaces 41 through each of the light guide parts 42 and the merging part 43. In the present embodiment, as shown in FIG. 1, the exit surface 44 is divided into a plurality of sections. The exit surface 44 includes a central exit surface 441 located at a central part in the direction X, and lateral exit surfaces 442 located laterally in the direction X with respect to the central exit surface 441. The central exit surface 441 and the lateral exit surfaces 442 are integrally formed on the end surface of the merging part 43.

The central exit surface 441 is formed at a position associated with four centrally arranged light sources 10 among the plurality of light sources 10. Further, as shown in FIG. 2, the central exit surface 441 is disposed in the vicinity of the focal point 30*a* of the projection lens 30. On the other hand, as shown in FIG. 1, the lateral exit surface 442 extends toward the front side in the direction Y, as the distance thereof from the central exit surface 441 increases. Specifically, the lateral exit surface 442 is located forward in the direction Y with respect to the central exit surface 441. Therefore, the central exit surface 441 is disposed closer to the focal point 30*a* of the projection lens 30 than the lateral exit surface 442. In the present embodiment, as shown in FIG. 2, a vicinity of an upper end 44*a* of the central exit surface 441 is disposed at a position where the vicinity overlaps the focal point 30*a* of the projection lens 30. An upper end 44*a* of the lateral exit surface 442 is located farther from the focal point 30*a* than the upper end 44*a* of the central exit surface 441 in the direction X and the direction Y (horizontal direction), but is disposed along a meridional image plane in the vertical direction. Specifically, the upper end 44*a* of the exit surface 44 is disposed in the vicinity of the focal point 30*a* of the projection lens 30 in the vertical direction. Further, as shown in FIG. 2, a lower end 44*b* of the exit surface 44 in the vertical direction is disposed closer to the projection lens 30 than the upper end 44*a* in the vertical direction. In other words, the exit surface 44 extends with an inclination toward the projection lens 30, as the exit surface 44 extends from the upper end 44*a* toward the lower end 44*b*.

Figure 4:
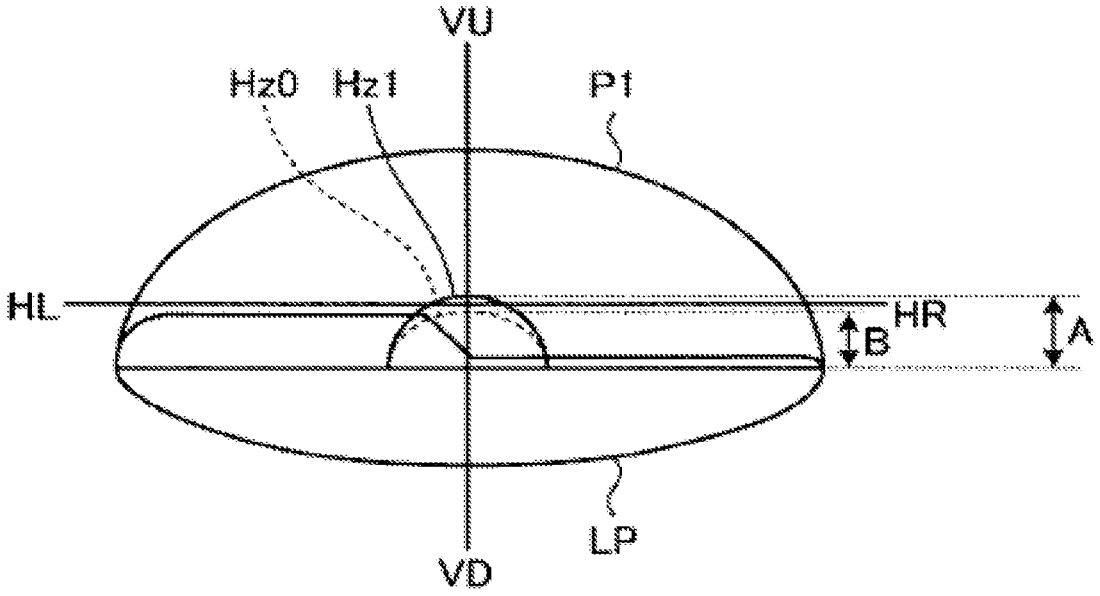
FIG. 4 is a diagram showing one example of an ADB light distribution pattern projected on a screen in front of a vehicle in the lamp for vehicles according to the embodiment.

Light incident from the light source 10 passes through the vehicle light guide 40 while being reflected on the upper reflective surface 451 and the lower reflective surface 452, is output from the exit surface 44, and is irradiated toward the front side of the vehicle via the projection lens 30. In this way, light irradiated toward the front side of the vehicle via the projection lens 30 forms an ADB light distribution pattern as described above. FIG. 4 is a diagram showing one example of the ADB light distribution pattern projected on a screen in front of a vehicle in the vehicle lamp according to the embodiment. In FIG. 4, the reference numeral "VU-VD" indicates a vertical line of the screen, and the reference numeral "HL-HR" indicates a horizontal line on the left and right of the screen. As shown in FIG. 4, an ADB light distribution pattern P1 irradiates the upper side of a low beam light distribution pattern LP that is irradiated from an unillustrated low beam lamp unit. The ADB light distribution pattern P1 passes through the incident surface 41 and the light guide part 42 formed in association with each of the light sources 10, is output from the exit surface 44, and is divided into a plurality of patterns (not shown), which are irradiated from the projection lens 30. Further, in the present embodiment, the ADB light distribution pattern P1 forms a high beam light distribution pattern by irradiation in a range shown in FIG. 4. Alternatively, the vehicle lamp 100 may separately include a high beam lamp unit for acquiring a high beam light distribution pattern.

As shown in FIG. 4, the ADB light distribution pattern P1 includes a hot zone Hz1 as a maximum luminous intensity band or a maximum illuminance band. In the present embodiment, after having been reflected on the lower reflective surface 452 of the vehicle light guide 40, light that passes through the focal point 30*a* or its vicinity and is irradiated from the projection lens 30 irradiates the hot zone Hz1. Further, after having been reflected on each reflective surface of the vehicle light guide 40, light that is output from a portion other than the focal point 30*a* or its vicinity and is irradiated from the projection lens 30 irradiates the periphery of the hot zone Hz1.

In the vehicle lamp 100 according to the present embodiment, by individually switching lighting states of the plurality of light sources 10, it is possible to adjust a range of light that passes through each of the incident surfaces 41 and each of the light guide parts 42 from each of the light sources 10, and is irradiated from the projection lens 30. In other words, by turning off a part of the plurality of light sources 10 disposed along the direction X, it is possible to prevent a part of a plurality of divided patterns of the ADB light distribution pattern P1 shown in FIG. 4 from being irradiated. Thus, it is possible to set a predetermined range in a horizontal direction of the screen, as a range in which light is not irradiated. Consequently, when an oncoming vehicle or a preceding vehicle is detected in front of the vehicle, it is possible to prevent the oncoming vehicle or the preceding vehicle from being dazzled by preventing light from being irradiated in an area of the ADB light distribution pattern P1 where the oncoming vehicle or the preceding vehicle is present.

Figure 3:
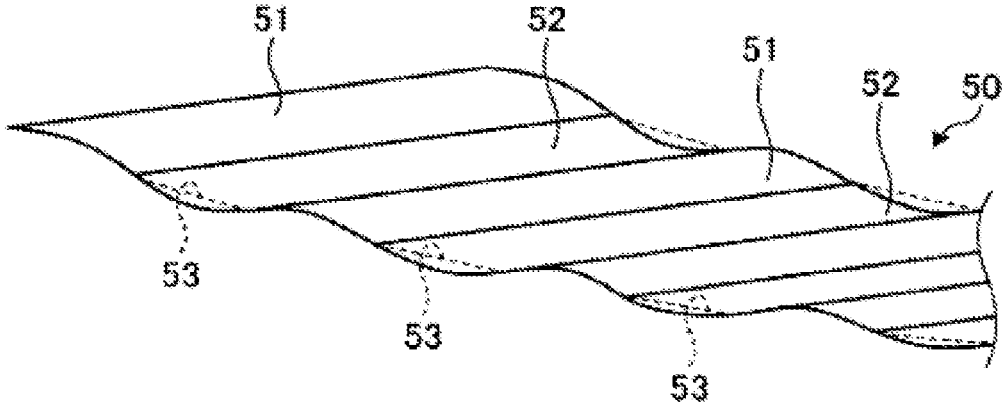
FIG. 3 is an enlarged perspective view showing a light diffusing part formed on the vehicle light guide.

The structure of the vehicle light guide 40 is described in more detail with reference to FIGS. 2 and 3. FIG. 3 is an enlarged perspective view showing a light diffusing part formed on the vehicle light guide. As shown in FIGS. 2 and 3, a light diffusing part 50 that diffuses light is formed, within a predetermined area, on the lower reflective surface 452 where the light guide part 42 continuing to the central exit surface 441 is formed.

The light diffusing part 50 is formed in a predetermined area of the reflective surface 45 extending from the incident surface 41 to the central exit surface 441. In the present embodiment, the light diffusing part 50 is formed in the entire area of the lower reflective surface 452 in the direction X within a predetermined range. As shown in FIG. 2, the predetermined range is a range from an intersection 61 between a central axis 10*a* of light emitted from the light source 10 and the lower reflective surface 452, to an intersection 62 between a line L1 along a half-value angle θ of the light emitted from the light source 10 and the lower reflective surface 452. The half-value angle θ is an angle at which an intensity of light emitted from the light source 10 is halved, and is 60° in the light source 10 that forms a Lambertian distribution.

The light diffusing part 50 includes a plurality of convex parts 51 and a plurality of concave parts 52. In the light diffusing part 50, the convex part 51 and the concave part 52 are disposed continuously in order. The convex part 51 and the concave part 52 adjacent to each other are smoothly connected to each other. Specifically, a portion (concave part 52 in the present embodiment) adjacent to the convex part 51, and a portion (convex part 51 in the present embodiment) adjacent to the concave part 52 do not have corner portions (edges), and are formed to be a smooth continuous surface. Thus, as shown in FIGS. 2 and 3, the light diffusing part 50 is formed into a waveform shape by the continuous convex parts 51 and concave parts 52. In this configuration, among the light incident on the vehicle light guide 40 from the light source 10, light reflected on the light diffusing part 50 is diffused by the plurality of convex parts 51 and the plurality of concave parts 52, as shown by solid arrows in FIG. 2. Consequently, a vertical thickness of the hot zone Hz1 formed by reflected light that is reflected on the lower reflective surface 452 and passes through the focal point 30*a* is increased by diffusion of reflected light on the light diffusing part 50.

In FIG. 4, a hot zone Hz0 shown by the broken line is a hot zone, as a comparative example, in a case where the lower reflective surface 452 is irradiated with the ADB light distribution pattern P1 via a vehicle light guide having a shape extending flat without the light diffusing part 50, specifically, without the plurality of convex parts 51 and the plurality of concave parts 52. As illustrated, a vertical thickness A of the hot zone Hz1 in the vehicle lamp 100 according to the embodiment is larger than a thickness B of the hot zone Hz0 as a comparative example. Specifically, the vertical thickness of the hot zone Hz1 in the vehicle lamp 100 according to the embodiment increases, as compared with the comparative example. In this way, by forming the light diffusing part 50 on the vehicle light guide 40, it becomes possible to adjust the vertical thickness of the hot zone Hz1, and consequently, it is possible to form the hot zone Hz1 of a desired thickness. Therefore, the pitch and the height of the plurality of convex parts 51 and the plurality of concave parts 52 of the light diffusing part 50 may be determined according to a value of the vertical thickness A of the hot zone Hz1.

As described above, the vehicle lamp 100 according to the embodiment includes the light source 10, the projection lens 30, and the vehicle light guide 40. The vehicle light guide 40 according to the embodiment is the vehicle light guide 40 that guides light from the light source 10 toward the projection lens 30, and includes the incident surface 41 on which light from the light source 10 is incident, the reflective surface 45 that reflects light incident from the incident surface 41, and the exit surface 44 that outputs light reflected on the reflective surface 45. The reflective surface 45 includes the light diffusing part 50 where the plurality of convex parts 51 and the plurality of concave parts 52 that diffuse light are formed.

In this configuration, it is possible to diffuse light from the light source 10 by the light diffusing part 50 formed on the reflective surface 45, and sufficiently secure a vertical thickness of a predetermined area (hot zone Hz1 according to the present embodiment) of a light distribution pattern (ADB light distribution pattern P1 according to the present embodiment), which is formed by the vehicle lamp 100 including the vehicle light guide 40. By securing a thickness of the predetermined area, it is possible to reduce a difference in luminous intensity and a difference in illuminance between the predetermined area and other areas. Specifically, it is possible to suppress a sharp change in luminous intensity and illuminance between the predetermined area and the other areas, and smoothly continue the predetermined area and the other areas. Consequently, for example, even when a predetermined area of a light distribution pattern is shifted due to vertical aiming of the vehicle lamp 100 in the vertical direction, misalignment of each component, or the like, a desired luminous intensity and illuminance can be acquired more reliably within a target range. Therefore, it becomes possible to acquire a desired light distribution performance. In addition, it becomes possible to more reliably acquire a light distribution pattern in accordance with the regulations.

Further, the light diffusing part 50 is formed on the reflective surface 45 (lower reflective surface 452) for forming the hot zone Hz1 of the ADB light distribution pattern P1 irradiated from the projection lens 30.

In this configuration, it is possible to secure a vertical thickness of the hot zone Hz1 having a maximum luminous intensity band or a maximum illuminance band on the ADB light distribution pattern P1, and in which the thickness tends to reduce by light collection. It is possible to suppress a sharp change in luminous intensity and illuminance between the hot zone Hz1 and other areas, and smoothly continue the hot zone Hz1 and the other areas. Consequently, for example, even when the hot zone Hz1 is shifted due to vertical aiming of the vehicle lamp 100 in the vertical direction, misalignment of each component, or the like, a desired luminous intensity and illuminance can be more reliably acquired in a target range. Therefore, it becomes possible to acquire a desired light distribution performance.

Further, the light diffusing part 50 is connected in such a way that the convex part 51 or the concave part 52, and a portion adjacent to the convex part 51 or the concave part 52 are formed to be a smooth continuous surface.

In this configuration, it is possible to prevent a corner portion (edge) from being formed on the plurality of convex parts 51 and the plurality of concave parts 52 of the light diffusing part 50. Consequently, it becomes possible to easily form the vehicle light guide 40 by resin molding.

Further, the light diffusing part 50 is formed between the intersection 61 between the central axis 10*a* of light emitted from the light source 10 and the reflective surface 45 (lower reflective surface 452), and the intersection 62 between the line L1 along the half-value angle θ of the light emitted from the light source 10 and the reflective surface 45 (lower reflective surface 452).

In this configuration, it is possible to diffuse light having a sufficiently high intensity among the light emitted from the light source 10 by the light diffusing part 50, and sufficiently acquire a luminous intensity or illuminance of the hot zone Hz1, while securing a vertical thickness of the hot zone Hz1.

Further, a plurality of the incident surfaces 41 are formed side by side along the left and right directions of the vehicle in association with each of the plurality of light sources 10 disposed side by side along the left and right directions. The exit surface 44 includes the central exit surface 441 formed at a central part in the left and right directions, and the lateral exit surfaces 442 formed laterally in the left and right directions with respect to the central exit surface 441. The central exit surface 441 is formed closer to the focal point 30*a* of the projection lens 30 than the lateral exit surface 442. The light diffusing part 50 is formed on the reflective surface 45 extending from the incident surface 41 to the central exit surface 441.

In this configuration, it is possible to diffuse light having a high light intensity and output from the central exit surface 441 disposed in the vicinity of the focal point 30*a* of the projection lens 30 by the light diffusing part 50. Consequently, it is possible to reliably secure a vertical thickness of the hot zone Hz1.

Further, the vehicle lamp additionally includes a plurality of the light guide parts 42, each of which extends from the incident surface 41 and includes the reflective surface 45, and the merging part 43 where the plurality of light guide parts 42 merge. The central exit surface 441 and the lateral exit surface 442 are integrally formed on an end surface of the merging part 43 on the projection lens 30 side.

In this configuration, it is possible to suppress occurrence of spots and streaks in the ADB light distribution pattern P1, as compared with a case where the central exit surface 441 and the lateral exit surface 442 are formed on separate members.

Further, the upper end 44*a* of the exit surface 44 is disposed in the vicinity of the focal point 30*a* of the projection lens 30 in the vertical direction, and the lower end 44*b* is disposed closer to the projection lens 30 than the upper end 44*a*.

In this configuration, it is possible to output light obliquely upward from the exit surface 44. Consequently, it is possible to satisfactorily transmit light output from the exit surface 44, whose major part is located below the focal point 30*a* of the projection lens 30 in the vertical direction, toward the projection lens 30, and it becomes possible to improve light use efficiency.

In the present embodiment, the light diffusing part 50 is formed into a waveform shape by the plurality of convex parts 51 and the plurality of concave parts 52. However, as far as light from the light source 10 can be appropriately diffused, the light diffusing part 50 may have another shape. For example, the light diffusing part 50 may be formed by either one of the plurality of convex parts 51 and the plurality of concave parts 52. For example, the light diffusing part 50 may be formed by continuously forming the convex part 51 and a flat part 53 (see the broken line in FIG. 3). The flat part 53 has an elliptical shape similar to the shape in a range other than the portion of the lower reflective surface 452 where the light diffusing part 50 is formed. Further, the light diffusing part 50 may be formed by continuously forming the concave part 52 and the flat part 53. Also in this case, in order to secure manufacturing easiness of the vehicle light guide 40, the convex part 51 (or the concave part 52) and the flat part 53 may preferably be connected to be a smooth continuous surface in such a way that a corner portion is not formed.

Further, in the present embodiment, the light diffusing part 50 is formed in the entire area of the lower reflective surface 452 in the direction X within a predetermined range. Alternatively, the light diffusing part 50 may be formed only in a part of a range of the lower reflective surface 452 in the direction X within a predetermined range. Further alternatively, the light diffusing part 50 may not be formed in the entire length of a range between the intersection 61 between the central axis 10*a* of the light source 10 and the reflective surface 45 (lower reflective surface 452), and the intersection 62 between the line L1 along the half-value angle θ of the light from the light source 10 and the reflective surface 45 (lower reflective surface 452), but may be formed only on a part of the range.

Further, in the present embodiment, the light diffusing part 50 is formed on the lower reflective surface 452 of the light guide part 42 continuing to the central exit surface 441. Alternatively, the light diffusing part 50 may be formed only on a part of the light guide part 42 continuing to the central exit surface 441, or may be formed on the light guide part 42 continuing to the lateral exit surface 442.

Further, in the present embodiment, the light diffusing part 50 is formed on the lower reflective surface 452 for forming the hot zone Hz1. Alternatively, the light diffusing part 50 may be formed on any part of the reflective surface 45 for forming an area other than the hot zone Hz1 on the ADB light distribution pattern P1. Further, in the present embodiment, the light diffusing part 50 diffuses light to secure a vertical thickness of a predetermined area on a light distribution pattern in the vertical direction. Alternatively, the light diffusing part 50 may be configured to diffuse light to secure a thickness of the predetermined area in the horizontal direction or in any direction.

Further, a reflective member that reflects light more advantageously may be formed on a surface of the vehicle light guide 40 at a position where the light diffusing part 50 is formed. The reflective member may be formed by, for example, vapor deposition.

DESCRIPTION OF REFERENCE NUMERALS

10 Light source
10*a* Central axis
11 Light emitting surface
20 Light source substrate
30*a* Focal point
30 Projection lens
40 Vehicle light guide
40*a* Mounting part
41 Incident surface

42 Light guide part
43 Merging part
44 Exit surface
441 Central exit surface
442 Lateral exit surface
45 Reflective surface
451 Upper reflective surface
452 Lower reflective surface
50 Light diffusing part
51 Convex part
52 Concave part
53 Flat part
100 Vehicle lamp

The invention claimed is:

1. A light guide for vehicles that guides light from a light source toward a projection lens, comprising:

an incident surface on which light from the light source is incident;

a reflective surface that reflects light incident from the incident surface;

an exit surface that outputs light reflected on the reflective surface, wherein the light guide is disposed on a lower side of an optical axis of the projection lens such that in a vertical cross-sectional view, a vicinity of an upper end of the exit surface is positioned on the optical axis so that the vicinity overlaps a focal point of the projection lens and a lower end of the exit surface is closer to the projection lens than the upper end in a direction of the optical axis, and the reflective surface includes an upper reflective surface located on an upper side in a vertical direction and a lower reflective surface located on a lower side in the vertical direction, and the reflective surface includes a light diffusing part where at least either one of a plurality of convex parts and a plurality of concave parts are formed to diffuse, in the vertical direction, the light incident into the incident surface to cause the light to output from the exit surface such that the light diffused by the light diffusing part passes the vicinity of the upper end of the exit surface to be distributed in the vertical direction and form a hot zone of a light distribution pattern irradiated from the projection lens.

2. The light guide for vehicles according to claim 1, wherein the light diffusing part is connected in such a way that the convex part or the concave part, and a portion adjacent to the convex part or the concave part are formed to be a smooth continuous surface.

3. The light guide for vehicles according to claim 1, wherein the light diffusing part is formed on at least a part between an intersection between a central axis of light emitted from the light source and the lower reflective surface, and an intersection between a line along a half-value angle of light emitted from the light source and the lower reflective surface.

4. The light guide for vehicles according to claim 1, wherein a plurality of the incident surfaces are formed side by side along left and right directions of a vehicle in association with each of a plurality of the light sources disposed side by side along the left and right directions, the exit surface includes a central exit surface formed at a central part in the left and right directions, and lateral exit surfaces formed laterally in the left and right directions with respect to the central exit surface, the central exit surface is formed closer to a focal point of the projection lens than the lateral exit surface, and the light diffusing part is formed on the lower reflective surface extending from the incident surface to the central exit surface.

5. The light guide for vehicles according to claim 4, further comprising a plurality of light guide parts extending from the incident surface and including the reflective surface; and a merging part where the plurality of light guide parts merge, wherein the central exit surface and the lateral exit surface are integrally formed on an end surface of the merging part on a side of the projection lens.

6. A lamp for vehicles, comprising:

a light source;

a projection lens; and the light guide for vehicles according to claim 1.

* * * * *